US006464858B1

(12) United States Patent
Brown et al.

(10) Patent No.: US 6,464,858 B1
(45) **Date of Patent: *Oct. 15, 2002**

(54) METHOD FOR IMPROVING THE YIELD OF HEAVY HYDROCARBONS IN A THERMAL CRACKING PROCESS

(75) Inventors: Ronald E. Brown, Bartlesville, OK (US); Larry E. Reed, Bartlesville, OK (US); James P. Degraffenried, Bartlesville, OK (US); Timothy P. Murtha, Bartlesville, OK (US); Gil J. Greenwood, Bartlesville, OK (US); Timothy P. Harper, Bartlesville, OK (US); Mark D. Scharre, Bartlesville, OK (US)

(73) Assignee: Phillips Petroleum Company, Bartlesville, OK (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/296,292

(22) Filed: Aug. 25, 1994

(51) Int. Cl.[7] ..... C10G 9/12

(52) U.S. Cl. ..... 208/48 AA; 208/48 R; 585/950

(58) Field of Search ..... 208/48 R, 48 AA; 585/950

(56) References Cited

U.S. PATENT DOCUMENTS

| | | | | |
|---|---|---|---|---|
| 4,404,087 | A | 9/1983 | Reed et al. | 208/48 AA |
| 4,692,234 | A | 9/1987 | Porter et al. | 208/48 |
| 5,284,994 | A | 2/1994 | Brown et al. | 585/648 |

FOREIGN PATENT DOCUMENTS

| | | | |
|---|---|---|---|
| EP | A0241020 | 8/1987 | C07C/4/04 |
| GB | A1053751 | 6/1963 | C10G/9/14 |

*Primary Examiner*—Bekir L. Yildirim
(74) *Attorney, Agent, or Firm*—Charles W. Stewart

(57) ABSTRACT

The incremental yield of hydrocarbons having five or more carbon atoms in a cracked product from a thermal cracking process is increased by contacting or treating the tubes of a thermal cracking furnace with a composition comprising tin and silicon.

23 Claims, 3 Drawing Sheets

Figure 1:
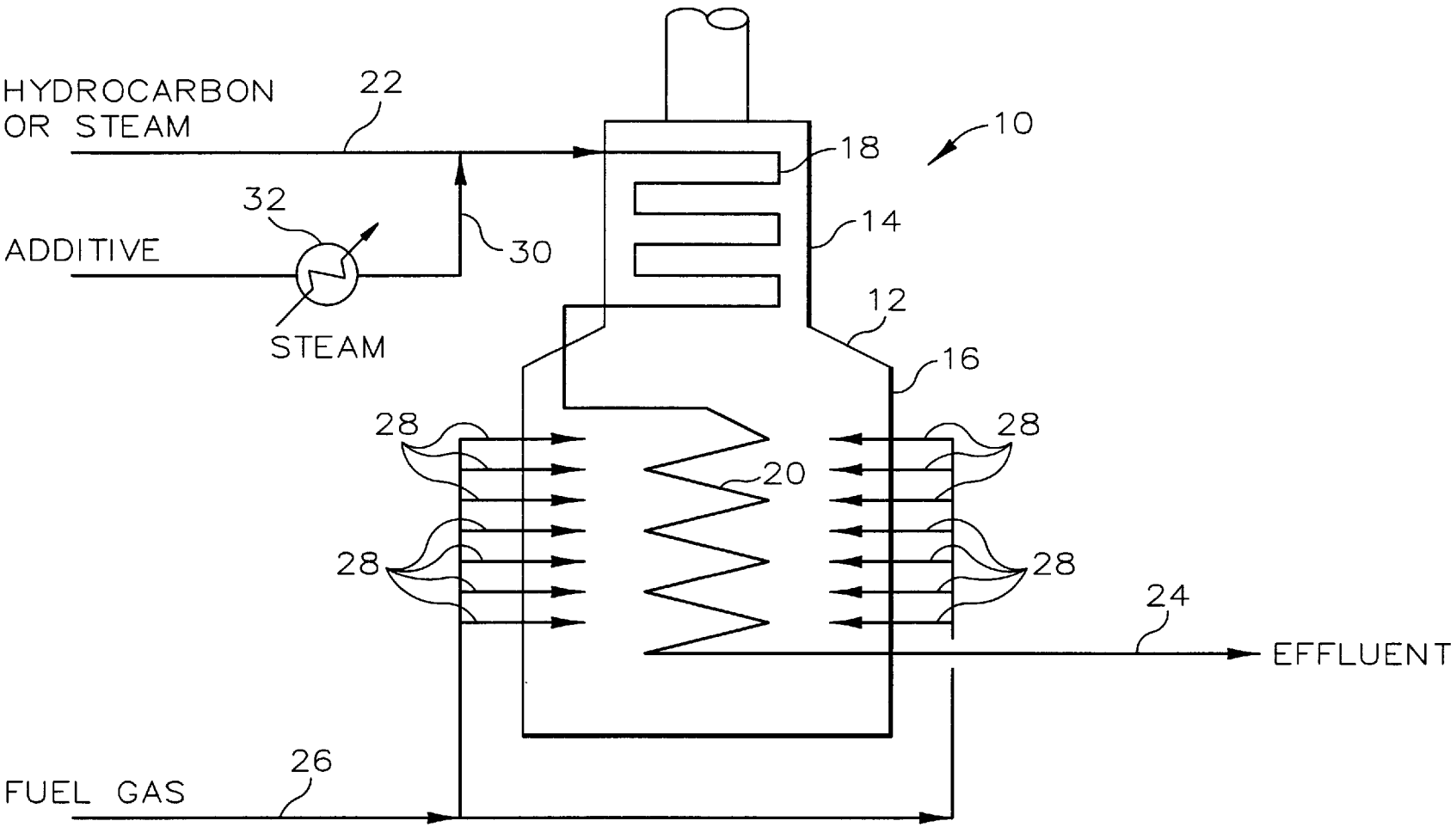

METHOD FOR IMPROVING THE YIELD OF HEAVY HYDROCARBONS IN A THERMAL CRACKING PROCESS

The present invention generally relates to processes for the thermal cracking of hydrocarbons and, specifically, to a method for increasing the yield of hydrocarbons having five or more carbon atoms in a process for the thermal cracking of hydrocarbons.

In a process for producing an olefin compound, a fluid stream containing a saturated hydrocarbon such as ethane, propane, butane, pentane, naphtha, or mixtures of two or more thereof is fed into a thermal (or pyrolytic) cracking furnace. A diluent fluid such as steam is usually combined with the hydrocarbon feed material being introduced into the cracking furnace.

Within the furnace, the saturated hydrocarbon is converted into an olefinic compound. For example, an ethane stream introduced into the cracking furnace is converted into ethylene and appreciable amounts of other hydrocarbons. A propane stream introduced into the furnace is converted to ethylene and propylene, and appreciable amounts of other hydrocarbons. Similarly, a mixture of saturated hydrocarbons containing ethane, propane, butane, pentane and naphtha is converted to a mixture of olefinic compounds containing ethylene, propylene, butenes, pentenes, and naphthalene. Olefinic compounds are an important class of industrial chemicals. For example, ethylene is a monomer or comonomer for making polyethylene. Other uses of olefinic compounds are well known to those skilled in the art.

As a result of the thermal cracking of a hydrocarbon, the cracked product stream can also contain appreciable quantities of hydrogen, methane, acetylene, carbon monoxide, carbon dioxide, and pyrolytic products other than the olefinic compounds.

In thermal or pyrolytic cracking processes, saturated hydrocarbons, particularly hydrocarbons having less than five carbon atoms, are converted from higher molecular weight compounds to lower molecular weight compounds. In the case of ethane cracking, ethane is converted to lower molecular weight ethylene. But, the cracking of ethane also results in the conversion of ethane to such undesirable lighter compounds as hydrogen, methane, and acetylene. Desirable compounds other than the ethylene produced by the cracking of ethane are hydrocarbons having at least five carbon atoms. Because of the lower value of the undesirable lighter compounds relative to hydrocarbons having at least five carbon atoms, it is preferred and can be economically beneficial to increase the production of the more desirable compounds at the expense of an offsetting reduction in the production of the undesirable lighter compounds.

It is thus an object of this invention to provide an improved process for cracking saturated hydrocarbons to produce olefinic end-products.

Another object of this invention is to provide a process for enhancing the yield of hydrocarbons having at least five carbon atoms in a process for cracking saturated hydrocarbons.

A still further object of this invention is to improve the economic efficiency of operating a cracking process for cracking saturated hydrocarbons by shifting the production of light ends to the production of hydrocarbons having at least five carbon atoms.

In accordance with one embodiment of the invention, a tube of a cracking furnace is contacted with a composition containing a tin compound and a silicon compound to thereby provide a treated tube. The treated tube is charged with a saturated hydrocarbon stream while the treated tube is being operated under suitable conditions for cracking the saturated hydrocarbon stream to produce a product stream having a concentration of hydrocarbon compounds having at least five carbon atoms. A portion of the concentration of hydrocarbon compounds having at least five carbon atoms is recovered.

Another embodiment of the invention includes a method for incrementally increasing the yield of hydrocarbon compounds having at least five carbon atoms in a product stream produced by a thermal cracking process for cracking a saturated hydrocarbon stream. A composition containing a tin compound and a silicon compound is added to the saturated hydrocarbon stream during cracking under suitable cracking conditions. A portion of the incremental yield of hydrocarbons having at least five carbon atoms is thereafter recovered.

Figure 2:
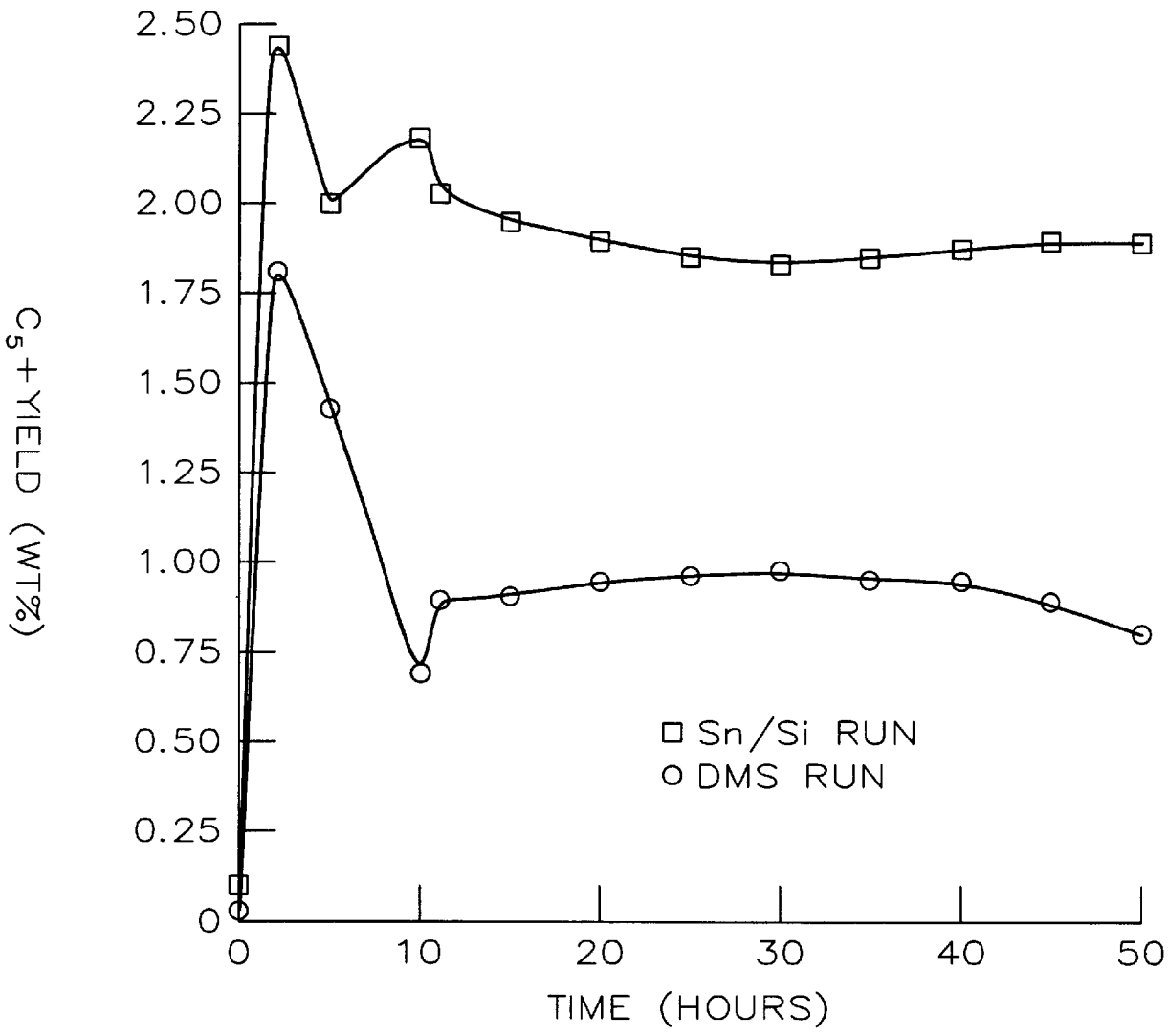
Figure 3:
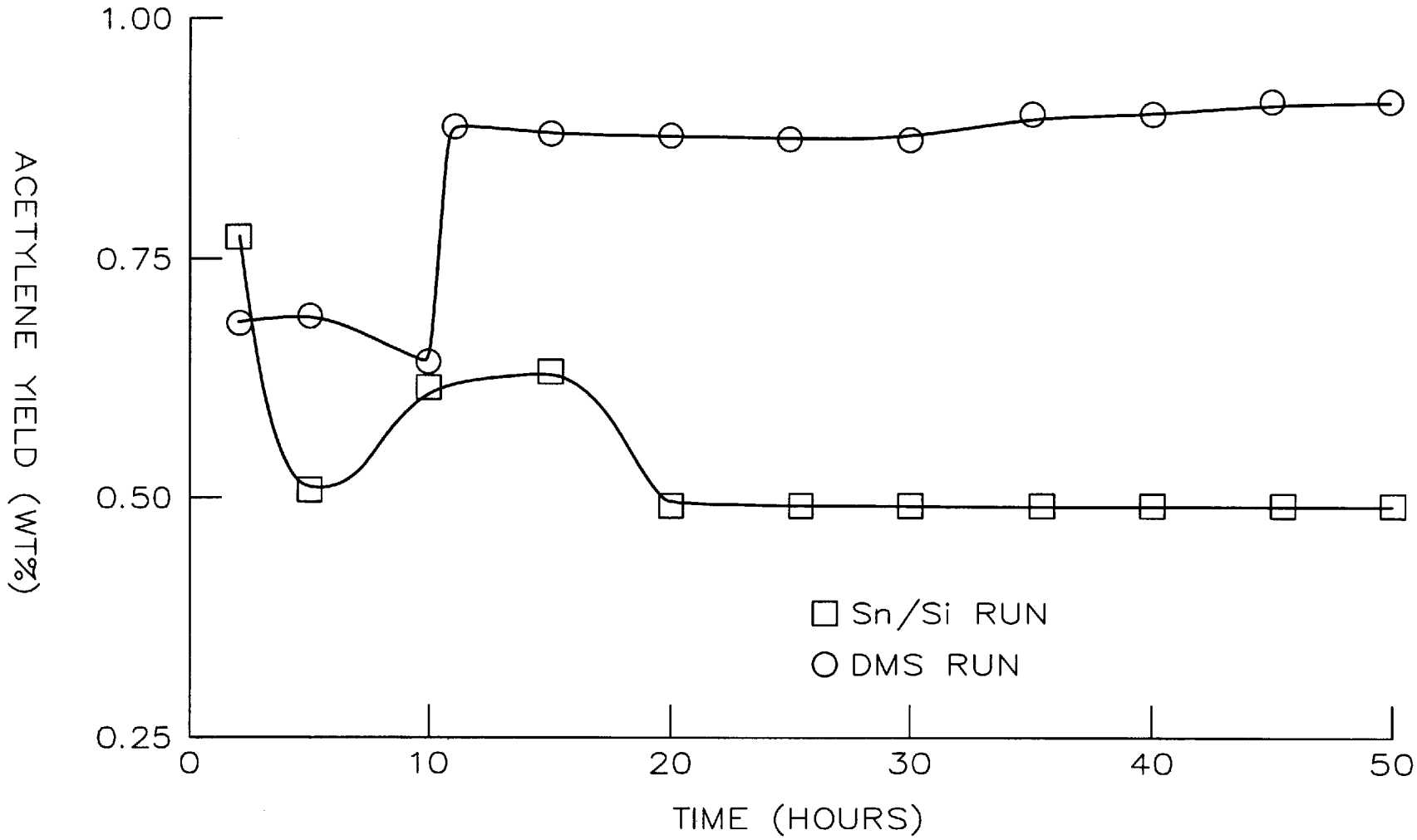

Other objects and advantages of the invention will be apparent from the description of the invention and the appended claims thereof as well as from the detailed description of the drawing in which:

FIG. 1 is a schematic diagram representing the portion of an ethylene cracking process that includes pyrolytic cracking furnace means;

FIG. 2 includes plots of the $C_5$+ yield in the cracked product at a substantially fixed ethane conversion for an untreated cracking tube and a cracking tube treated in accordance with the novel methods described herein; and FIG. 3 includes plots of the acetylene yield in the cracked product at a substantially fixed ethane conversion for an untreated cracking tube and a cracking tube treated in accordance with the novel methods described herein.

The process of this invention involves the pyrolytic cracking of hydrocarbons to produce desirable hydrocarbon end-products. A hydrocarbon stream is fed or charged to pyrolytic cracking furnace means wherein the hydrocarbon stream is subjected to a severe, high-temperature environment to produce cracked gases. The hydrocarbon stream can comprise any type of hydrocarbon that is suitable for pyrolytic cracking to olefin compounds. Preferably, however, the hydrocarbon stream can comprise paraffin hydrocarbons selected from the group consisting of ethane, propane, butane, pentane, naphtha, and mixtures of any two or more thereof. Naphtha can generally be described as a complex hydrocarbon mixture having a boiling range of from about 180° F. to about 400° F. as determined by the standard testing methods of the American Society of Testing Materials (ASTM).

The pyrolytic cracking of higher molecular weight hydrocarbons to lower molecular weight hydrocarbons can be referred to as conversion. The terms "conversion", "feed conversion", and similar such terminology, as used throughout this specification, are defined as the ratio of the difference between the mass of saturated hydrocarbons charged to a cracking zone and the mass of unconverted saturated hydrocarbons leaving, as an effluent, such cracking zone divided by the mass of saturated hydrocarbons charged to the cracking zone. The numerical value for conversion can be reported as a fraction (ratio) or as a percentage. Conversion can also be reported on an individual compound basis such as, for example, ethane conversion, propane conversion, butane conversion, and the like.

As an optional feature of the invention, the hydrocarbon feed being charged to pyrolytic cracking furnace means can be intimately mixed with a diluent prior to entering pyrolytic cracking furnace means. This diluent can serve several positive functions, one of which includes providing desirable reaction conditions within pyrolytic cracking furnace means for producing the desired reactant end-products. The diluent does this by providing for a lower partial pressure of hydrocarbon feed fluid thereby enhancing the cracking reactions necessary for obtaining the desired olefin products while reducing the amount of undesirable reaction products such as hydrogen and methane. Also, the lower partial pressure resulting from the mixture of the diluent fluid helps in minimizing the amount of coke deposits that form on the furnace tubes. While any suitable diluent fluid that provides these benefits can be used, the preferred diluent fluid is steam.

The cracking reactions induced by pyrolytic cracking furnace means can take place at any suitable temperature that will provide the necessary cracking to the desirable end-products or the desired feed conversion. The actual cracking temperature utilized will depend upon the composition of the hydrocarbon feed stream and the desired feed conversion. Generally, the cracking temperature can range upwardly to about 2000° F. or greater depending upon the amount of cracking or conversion desired and the molecular weight of the feedstock being cracked. Preferably, however, the cracking temperature will be in the range of from about 1200° F. to about 1900° F. Most preferably, the cracking temperature can be in the range from 1500° F. to 1800° F.

The cracked hydrocarbon effluent or cracked hydrocarbons or cracked hydrocarbon stream from pyrolytic cracking furnace means will generally be a mixture of hydrocarbons in the gaseous phase. This mixture of gaseous hydrocarbons can comprise not only the desirable olefin compounds, such as ethylene, propylene, butylene, and amylene; but, also, the cracked hydrocarbon stream can contain undesirable contaminating components, which include both oxygenated compounds and acidic compounds, and light ends such as hydrogen, methane and acetylene.

The cracking furnace means of the inventive method can be any suitable thermal cracking furnace known in the art. The various cracking furnaces are well known to those skilled in the art of cracking technology and the choice of a suitable cracking furnace for use in a cracking process is generally a matter of preference. Such cracking furnaces, however, are equipped with at least one cracking tube to which the hydrocarbon feedstock is charged or fed. The cracking tube provides for and defines a cracking zone contained within the cracking furnace. The cracking furnace is utilized to release the heat energy required to provide for the necessary cracking temperature within the cracking zone in order to induce the cracking reactions therein. Each cracking tube can have any geometry which suitably defines a volume in which cracking reactions can take place and, thus, will have an inside surface. The term "cracking temperature" as used herein is defined as being the temperature within the cracking zone defined by a cracking tube. The outside wall temperature of the cracking tube can, thus, be higher than the cracking temperature and possibly substantially higher due to heat transfer considerations. Typical pressures within the cracking zone will generally be in the range of from about 5 psig to about 25 psig and, preferably from 10 psig to 20 psig.

The inventive method includes the treatment or treating of the tubes of a cracking furnace by contacting the surfaces of such tubes with a $C_5$+ production enhancing composition. The term "$C_5$+" as used herein is defined as being hydrocarbons having at least five carbon atoms. The use of the $C_5$+ production enhancing composition provides for or induces an incremental increase in the production of hydrocarbons having at least five carbon atoms, or $C_5$+, in a cracked product stream above the amount of $C_5$+ produced where the $C_5$+ production enhancing composition is not utilized to treat the cracker tubes used to produce the cracked product stream. Therefore, for similar cracking conditions, the concentration of $C_5$+ in the cracked product stream from cracker tubes which have been treated with the $C_5$+ production enhancing composition is greater than the concentration of $C_5$+ in the cracked product stream from cracker tubes which have not been treated. The $C_5$+ production enhancing composition is a combination or mixture of tin and silicon; thus, the composition will comprise, consist essentially of, or consist of tin and silicon.

Any suitable form of silicon can be utilized in the $C_5$+ production enhancing composition comprising tin and silicon. Elemental silicon, inorganic silicon compounds and organic silicon (organosilicon) compounds as well as mixtures of any two or more thereof are suitable sources of silicon. The term "silicon" generally refers to any one of these silicon sources.

Examples of some inorganic silicon compounds that can be used include the halides, nitrides, hydrides, oxides and sulfides of silicon, silicic acids and alkali metal salts thereof. Of the inorganic silicon compounds, those which do not contain halogen are preferred.

Examples of organic silicon compounds that may be used include compounds of the formula

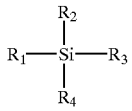

wherein $R_1$, $R_2$, $R_3$, and $R_4$ are selected independently from the group consisting of hydrogen, halogen, hydrocarbyl, and oxyhydrocarbyl and wherein the compound's bonding may be either ionic or covalent. The hydrocarbyl and oxyhydrocarbyl radicals can have from 1 to 20 carbon atoms which may be substituted with halogen, nitrogen, phosphorus, or sulfur. Exemplary hydrocarbyl radicals are alkyl, alkenyl, cycloalkyl, aryl, and combinations thereof, such as alkylaryl or alkylcycloalkyl. Exemplary oxyhydrocarbyl radicals are alkoxide, phenoxide, carboxylate, ketocarboxylate and diketone (dione). Suitable organic silicon compounds include trimethylsilane, tetramethylsilane, tetraethylsilane, triethylchlorosilane, phenyltrimethylsilane, tetraphenylsilane, ethyltrimethoxysilane, propyltriethoxysilane, dodecyltrihexoxysilane, vinyltriethyoxysilane, tetramethoxyorthosilicate, tetraethoxyorthosilicate, polydimethylsiloxane, polydiethylsiloxane, polydihexylsiloxane, polycyclohexylsiloxane, polydiphenylsiloxane, polyphenylmethylsiloxane, 3-chloropropyltrimethoxysilane, and 3-aminopropyltriethoxysilane. At present hexamethyldisiloxane is preferred.

Organic silicon compounds are particularly preferred because such compounds are soluble in the feed material and in the diluents which are preferred for preparing pretreatment solutions as will be more fully described hereinafter. Also, organic silicon compounds appear to have less of a tendency towards adverse effects on the cracking process than do inorganic silicon compounds.

Any suitable form of tin can be utilized in the $C_5$+ production enhancing composition comprising tin and silicon. Elemental tin, inorganic tin compounds and organic tin (organotin) compounds as well as mixtures of any two or more thereof are suitable sources of tin. The term "tin" generally refers to any one of these tin sources.

Examples of some inorganic tin compounds which can be used include tin oxides such as stannous oxide and stannic oxide; tin sulfides such as stannous sulfide and stannic sulfide; tin sulfates such as stannous sulfate and stannic sulfate; stannic acids such as metastannic acid and thiostannic acid; tin halides such as stannous fluoride, stannous chloride, stannous bromide, stannous iodide, stannic fluoride, stannic chloride, stannic bromide and stannic iodide; tin phosphates such as stannic phosphate; tin oxyhalides such as stannous oxychloride and stannic oxychloride; and the like. Of the inorganic tin compounds those which do not contain halogen are preferred as the source of tin.

Examples of some organic tin compounds which can be used include tin carboxylates such as stannous formate, stannous acetate, stannous butyrate, stannous octoate, stannous decanoate, stannous oxalate, stannous benzoate, and stannous cyclohexanecarboxylate; tin thiocarboxylates such as stannous thioacetate and stannous dithioacetate; dihydrocarbyltin bis(hydrocarbyl mercaptoalkanoates) such as dibutyltin bis(isoocylmercaptoacetate) and dipropyltin bis(butyl mercaptoacetate); tin thiocarbonates such as stannous O-ethyl dithiocarbonate; tin carbonates such as stannous propyl carbonate; tetrahydrocarbyltin compounds such as tetramethyltin, tetrabutyltin, tetraoctyltin, tetradodecyltin, and tetraphenyltin; dihydrocarbyltin oxides such as dipropyltin oxide; dibutyltin oxide, dioctyltin oxide, and diphenyltin oxide; dihydrocarbyltin bis(hydrocarbyl mercaptide)s such as dibutyltin bis(dodecyl mercaptide); tin salts of phenolic compounds such as stannous thiophenoxide; tin sulfonates such as stannous benzenesulfonate and stannous-p-toluenesulfonate; tin carbamates such as stannous diethylcarbamate; tin thiocarbamates such as stannous propylthiocarbamate and stannous diethyldithiocarbamate; tin phosphites such as stannous diphenyl phosphite; tin phosphates such as stannous dipropyl phosphate; tin thiophosphates such as stannous O,O-dipropyl thiophosphate, stannous O,O-dipropyl dithiophosphate and stannic O,O-dipropyl dithiophosphate, dihydrocarbyltin bis(O,O-dihydrocarbyl thiophosphate)s such as dibutyltin bis(O,O-dipropyl dithiophosphate); and the like. At present tetrabutyltin is preferred. Again, as with silicon, organic tin compounds are preferred over inorganic compounds.

Any of the listed sources of tin can be can be combined with any of the listed sources of silicon to form the $C_5$+ production enhancing composition comprising tin and silicon.

The $C_5$+ production enhancing composition can have any molar ratio of tin to silicon which suitably provides for the cracker tube treatment or enhanced $C_5$+ production as required hereunder. Generally, however, the molar ratio of tin to silicon of the composition can be in the range of from about 1:100 to about 100:1. Preferably, the molar ratio can be from about 1:10 to about 10:1 and, most preferably, it can be from 1:4 to 4:1.

The $C_5$+ production enhancing composition is utilized in the treatment of the surfaces of the cracking tubes of a cracking furnace. The $C_5$+ production enhancing composition is contacted with surfaces of the cracking tubes either by pretreating the cracking tubes with the composition prior to charging the tubes with a hydrocarbon feed or by adding the composition to the hydrocarbon feed in an amount effective for incrementally increasing the yield of $C_5$+ above the yield when none of the composition is added to the hydrocarbon feed.

Any method can be used which suitably treats the tubes of a cracking furnace by contacting such tubes with the $C_5$+ production enhancing composition under suitable treatment conditions to thereby provide treated tubes. The treated tubes will provide for an incremental increase in the yield of $C_5$+ in the cracked product stream above the yields of $C_5$+ which will result from untreated tubes under similar cracking conditions.

The preferred procedure for pretreating the tubes of the cracking furnace, includes charging to the inlet of the cracking furnace tubes a saturated or slightly superheated steam having a temperature in the range of from about 300° F. to about 500° F. The cracking furnace is fired while charging the tubes with the steam so as to provide a superheated steam which exits the tubes at a temperature exceeding that of the steam introduced into the inlet of the tubes. Generally, the steam effluent will have a temperature upwardly to about 2000° F. Thus, the treating temperature can be in the range of from about 300° F. to about 2000° F., preferably, from about 400° F. to about 1800° F. and, most preferably, from 500° F. to 1600° F. It is desirable for the steam to be charged to the convection section of the cracking furnace therefore first passing through the convection section tubes followed by passing through the radiant section tubes.

The $C_5$+ production enhancing composition can then be admixed with the steam being charged to the cracker tubes. The $C_5$+ production enhancing composition can be admixed with the steam as either a neat liquid or as a mixture of the $C_5$+ production enhancing composition with an inert diluent. It is preferred, however, to first vaporize either the neat liquid or the mixture prior to its introduction into or admixing with the steam. The amount of $C_5$+ production enhancing composition admixed with the steam can be such as to provide a concentration of the $C_5$+ production enhancing composition in the steam in the range of from about 1 ppmw to about 10,000 ppmw, preferably, from about 10 ppmw to about 1000 ppmw and, most preferably, from 20 to 200 ppmw.

The admixture of steam and $C_5$+ production enhancing composition is contacted with or charged to the cracker tubes for a period of time sufficient to provide for treated tubes, which when placed in cracking service, will provide a cracked product stream having a relative concentration of hydrocarbons, having at least five carbon atoms, greater than that of a cracked product stream from untreated cracker tubes. Such time period for pretreating the cracker tubes is influenced by the specific geometry of the cracking furnace including its tubes; but, generally, the pretreating time period can range upwardly to about 12 hours, and longer if required. But, preferably, the period of time for the pretreating can be in the range of from about 0.1 hours to about 12 hours and, most preferably, from 0.5hours to 10 hours.

In the case where the $C_5$+ production enhancing composition is directly admixed with the hydrocarbon cracker feed, it can be added in such an amount to be effective in enhancing the $C_5$+ production above that which occurs when no $C_5$+ production enhancing composition is added. Due to the memory effect resulting from the application of the $C_5$+ production enhancing composition, the mixing with the hydrocarbon cracker feed is conducted intermittently as required but, preferably, for periods up to about 12 hours. The concentration of the $C_5$+ production enhancing composition in the hydrocarbon cracker feed during treating of the cracker tubes can be in the range of from about 1 ppmw to about 10,000 ppmw, preferably, from about 10 ppmw to about 1000 ppmw and, most preferably, from 20 to 200 ppmw.

The cracked product stream from the treated cracker tubes can further be processed to recover the $C_5$+ contained therein and to separate the components of the cracked product stream. Thus, the cracked product stream can be passed to separation means for separating the components of the cracked product stream. This separation generally includes the removal of light ends such as hydrogen and methane from the olefins and the recovery of the heavier $C_5$+. Any suitable recovery means can be used to recover the incremental increase in $C_5$+ yield that results from the use of the $C_5$+ production enhancing composition; but, generally, it includes, for example, flash separation, fractionation and solvent extraction. Fractionation is the preferred method by which the incremental $C_5$+ yield of the inventive method is recovered.

Now referring to FIG. 1, there is illustrated by schematic representation cracking furnace section 10 of a pyrolytic cracking process system. Cracking furnace section 10 includes pyrolytic cracking means or cracking furnace 12 for providing heat energy required for inducing the cracking of hydrocarbons. Cracking furnace 12 defines both convection zone 14 and radiant zone 16. Respectively within such zones are convection coils as tubes 18 and radiant coils as tubes 20.

A hydrocarbon feedstock or a mixture of steam and such hydrocarbon feedstock is conducted to the inlet of convection tubes 18 by way of conduit 22 which is in fluid flow communication with convection tubes 18. During the treatment of the tubes of cracking furnace 12, the admixture of steam and the $C_5$+ production enhancing composition can also be conducted to the inlet of convection tubes 18 through conduit 22. The feed passes through the tubes of cracking furnace 12 wherein it is heated to a cracking temperature in order to induce cracking or, in the situation where the tubes are undergoing treatment, to the required treatment temperature. The effluent from cracking furnace 12 passes downstream through conduit 24 where it is processed to remove light ends such as hydrogen and methane and where the olefins and the incremental yield of $C_5$+ are recovered. To provide for the heat energy necessary to operate cracking furnace 12, fuel gas is conveyed through conduit 26 to burners 28 of cracking furnace 12 whereby the fuel gas is burned and heat energy is released.

During the treatment of convection tubes 18 and radiant tubes 20, the $C_5$+ production enhancing composition is conveyed to cracking furnace 12 feed stream through conduit 30 and admixed prior to the resulting mixture entering cracking furnace 12. Interposed in conduit 30 is heat exchanger 32 which provides heat exchange means for transferring heat energy and to thereby vaporize the $C_5$+ production enhancing composition.

The following example is provided to further illustrate the present invention.

EXAMPLE

This example demonstrates the superiority of a tube treated with tin and silicon over a conventional furnace treatment of dimethylsulfide in enhancing the concentration of $C_5$+ in the cracked product stream in a process for the thermal cracking of hydrocarbons.

A 1.75" I.D. HP-Modified tube that was 12 feet in length was treated with 500 ppmw dimethylsulfide for four hours at 1250° F. Dimethylsulfide was introduced with 26.4 lb/hr steam and 3.5 lb/hr nitrogen at 400° F. and 40 psig several feet upstream of an electric furnace which enclosed the reactor tube. The feed rate was then changed to 25.3 lb/hr ethane and 7.6 lb/hr steam at 12 psig and the temperatures in the furnace were brought up to cracking conditions in a period of one hour. Residence time in the reactor tube was held at 270 milliseconds. The dimethylsulfide injection was reduced to 125 ppmw at twenty hours after the ethane charge was introduced and injection was continued for the remainder of the 56 hour test run. Conversion of the ethane was maintained at 67%. Cracked gas produced from this test showed a $C_5$+ yield that averaged 0.9 wt % of the product gases but decreased to 0.8 wt % at the end of the test run. Acetylene yield also averaged 0.9 wt % of the product gas.

A pretreatment of six hours with 100 ppmm tetrabutyltin and 50 ppmm hexamethyl disiloxane at temperatures from 1200° F. to 1500° F. and 40 psig was done on the same tube described above. This mixture was also injected at the same location as the dimethylsulfide with 26.4 lb/hr steam and 3.5 lb/hr nitrogen. The feed was then changed to 25.3 lb/hr ethane and 7.6 lb/hr steam and the temperatures in the furnace were brought up to cracking conditions and 67% ethane conversion in a period of one hour. Residence time in the reactor tube was held at 270 milliseconds. Four hours after the ethane charge was brought in, the concentration of the tin/silica mixture was reduced to 50 ppmm tetrabutyltin and 25 ppmm hexamethyl disiloxane. Eight hours after the ethane charge was brought in, the injection of the tin/silica mixture was discontinued for the remainder of the 191 hour test run. Cracked gas produced from this test showed a $C_5$+ yield that averaged 1.9 wt % throughout the test with no drop in consistency. Acetylene yield averaged 0.5wt % of the product gas.

Selected data points obtained from the two test runs described in this Example are presented in Table I. These data are presented in the plots of FIG. 2 and FIG. 3.

A comparison of the data obtained from the two test runs clearly demonstrates an increase in $C_5$+ yield (1 wt %) for the tin/silica treated tube and a decrease in the undesirable acetylene yield (0.4 wt %). Apparently, the inventive treatment method provides for a product shift with a reduction in the undesired acetylene yield contributing to an increase in the desired $C_5$+ yield.

TABLE I

Comparative Data for Conventional Dimethylsulfide (DMS) Treatment of Cracker Tubes Versus the Inventive Treatment of Cracker Tubes with Tin/Silicon (Sn/Si) Compound

| | $C_5$ + Yield (Wt %) | | | Acetylene Yield (Wt %) | | |
|---|---|---|---|---|---|---|
| Run Time (Hrs) | DMS Run | Sn/Si Run | Difference | DMS Run | Sn/Si Run | Difference |
| 10 | 1.1 | 2.19 | 1.09 | 0.63 | 0.62 | −0.01 |
| 15 | 0.90 | 1.95 | 1.05 | 0.89 | 0.63 | −0.26 |
| 20 | 0.93 | 1.90 | 0.97 | 0.86 | 0.49 | −0.37 |
| 25 | 0.99 | 1.86 | 0.87 | 0.9 | 0.49 | −0.41 |
| 30 | 0.99 | 1.83 | 0.84 | 0.86 | 0.49 | −0.37 |
| 35 | 1.06 | 1.87 | 0.81 | 0.95 | 0.49 | −0.46 |
| 40 | 0.91 | 1.88 | 0.97 | 0.88 | 0.49 | −0.39 |
| 45 | 0.90 | 1.90 | 1.0 | 0.91 | 0.49 | −0.42 |
| 50 | 0.84 | 1.90 | 1.06 | 0.90 | 0.49 | −0.41 |
| 55 | 0.79 | 1.91 | 1.12 | 0.92 | 0.49 | −0.43 |
| Average | 0.94 | 1.9 | 0.96 | 0.9 | 0.50 | −0.40 |

Reasonable variations and modifications are possible by those skilled in the art within the scope of the described invention and the appended claims.

That which is claimed is:

1. A method comprising the steps of:

(a) contacting a tube of a cracking furnace with a composition having $C_5$+ production enhancing properties containing tetrabutyltin and hexamethyldisiloxane to thereby provide a treated tube wherein said composition has a molar ratio of tetrabutyltin to hexamethyldisiloxane in the range of from about 1:10 to about 10:1;

(b) charging a saturated hydrocarbon stream to said treated cracking tube operated under suitable conditions for cracking said saturated hydrocarbon stream;

(c) producing a product stream having a concentration of hydrocarbon compounds having at least five carbon atoms greater than that of said product stream when the treatment of step (a) is not performed; and (d) recovering at least a portion of said concentration of hydrocarbon compounds having at least five carbon atoms.

2. A method as recited in claim 1 wherein said molar ratio of tetrabutyltin hexamethyldisiloxane is in the range of from 1:4 to 4:1.

3. A method as recited in claim 2 wherein the contacting step further includes utilizing said composition in an admixture with steam at a concentration in the range of from about 1 ppmw to about 10,000 ppmw.

4. A method as recited in claim 3 wherein the contacting step is conducted at a temperature in the range of from about 300° F. to 2000° F.

5. A method as recited in claim 4 wherein the contacting step is conducted for a time period upwardly to about 12 hours.

6. A method for incrementally increasing the yield of $C_5$+ in a product stream produced by a thermal cracking process for cracking a saturated hydrocarbon stream, said method comprises the steps of:

(a) contacting a tube of said cracking furnace with a composition containing tetrabutyltin and hexamethyldisoloxane to thereby provide a treated tube wherein said composition has a molar ratio of tetrabutyltin to hexamethyldisiloxane in the range of from about 1:10 to about 10;1;

(b) thereafter, charging said saturated hydrocarbon stream to said treated tube which is operated under cracking conditions; and (c) providing said product stream from said treated tube having a $C_5$+ concentration greater than that of said product stream produced by said tube when said tube is utilized under similar cracking conditions to those of said treated tube and without the treatment of step (a); and recovering the incremental increase in production of $C_5$+ resulting from the use of said treated tube.

7. A method as recited in claim 6 wherein said molar ratio of tetrabutyltin to hexamethyldisiloxane is in the range of from 1:4 to 4:1.

8. A method as recited in claim 7 wherein the contacting step further includes utilizing said composition in an admixture with steam at a concentration in the range of from about 1 ppmw to about 10,000 ppmw.

9. A method as recited in claim 8 wherein the contacting step is conducted at a temperature in the range of from about 300° F. to 2000° F.

10. A method as recited in claim 9 wherein the contacting step is conducted for a time period upwardly to about 12 hours.

11. A method for incrementally improving the yield of hydrocarbon compounds having at least five carbon atoms in a product stream produced by a thermal cracking process for cracking under suitable cracking conditions a hydrocarbon stream, said method comprising the steps of:

(a) adding a composition containing tetrabutyltin and hexamethyldisiloxane to said hydrocarbon stream in an amount effective for enhancing the production of hydrocarbons having at least five carbon atoms when said hydrocarbon stream undergoes cracking under said suitable cracking conditions and wherein the molar ratio of tetrabutyltin and hexamethyldisiloxane is in the range of from about 1:10 to about 10:1;

(b) subjecting said hydrocarbon stream containing said composition to said suitable cracking conditions;

(c) incrementally increasing the yield of hydrocarbons having at least five carbon atoms above the yield of such hydrocarbons produced when adding step (a) is not performed; and (d) recovering a portion of the incremental yield of said hydrocarbons having at least five carbon atoms.

12. A method as recited in claim 11 wherein in said molar ratio of tetrabutyltin to hexamethyldisiloxane is in the range of from 1:4 to 4:1.

13. A method as recited in claim 12 wherein said amount of said composition added to said hydrocarbon stream is such as to provide a concentration in the range of from 1 to 10,000 parts by weight of said composition per parts by weight of said hydrocarbon stream.

14. A method as recited in claim 13 wherein said cracking temperature is in the range of from 1200° F. to 2000° F.

15. A method for incrementally increasing the yield of $C_5$+ and incrementally decreasing the yield of acetylene in a product stream produced by a thermal cracking process for cracking a saturated hydrocarbon stream, said method comprises the steps of:

(a) contacting a tube of said cracking furnace with a composition containing tetrabutyltin and hexamethyldisiloxane to thereby provide a treated tube wherein said composition has a molar ratio of tetrabutyltin to hexamethyldisiloxane in the range of from about 1:10 to about 10:1;

(b) thereafter, charging said saturated hydrocarbon stream to said treated tube which is operated under cracking conditions;

(c) providing said product stream from said treated tube having a $C_5$+ concentration greater than and an acetylene concentration less than that of said product stream produced by said tube when said tube is utilized under similar cracking conditions to those of said treated tube and without the treatment of step (a); and recovering the incremental increase in production of $C_5$+ resulting from the use of said treated tube; and (d) recovering the incremental increase in production of $C_5$+ resulting from the use of said treated tube.

16. A method as recited in claim 15 wherein in said molar ratio of tetrabutyltin and hexamethyldisiloxane is in the range of from 1:4 to 4:1.

17. A method as recited in claim 16 wherein the contacting step further includes utilizing said composition in an admixture with steam at a concentration in the range of from about 1 ppmw to about 10,000 ppmw.

18. A method as recited in claim 17 wherein the contacting step is conducted at a temperature in the range of from about 300° F. to 2000° F.

19. A method as recited in claim 18 wherein the contacting step is conducted for a time period upwardly to about 12 hours.

20. A method for incrementally increasing the yield of hydrocarbon compounds having at least five carbon atoms and incrementally decreasing the yield of acetylene in a product stream produced by a thermal cracking process for cracking under suitable cracking conditions a hydrocarbon stream, said method comprising-the steps of:

(a) adding a composition containing tetrabutyltin and hexamethyldisiloxane and having a molar ratio of tetrabutyltin to hexamethyldisiloxane in the range of from about 1:10 to about 10:1 to said hydrocarbon stream and in such an amount effective for enhancing the production of hydrocarbons having at least five carbon atoms and decreasing the production of acetylene when said hydrocarbon stream undergoes cracking under said suitable cracking conditions;

(b) subjecting said hydrocarbon stream containing said composition to said suitable cracking conditions;

(c) incrementally increasing the yield of hydrocarbons having at least five carbon atoms above the yield of such hydrocarbons produced when adding step (a) is not performed; and (d) recovering a portion of the incremental yield of said hydrocarbons having at least five carbon atoms.

21. A method as recited in claim 20 wherein said molar ratio of tetrabutyltin and hexamethyldisiloxane is in the range of from 1:4 to 4:1.

22. A method as recited in claim 21 wherein said amount of said composition added to said hydrocarbon stream is such as to provide a concentration in the range of from 1 to 10,000 parts by weight of said composition per parts by weight of said Hydrocarbon stream.

23. A method as recited in claim 22 wherein said cracking temperature is in the range of from 1200° F. to 2000° F.

* * * * *